US005826527A

United States Patent [19]

Migliorini

[11] Patent Number: 5,826,527

[45] Date of Patent: Oct. 27, 1998

[54] APPARATUS FOR TREATING KNITTED TUBULAR ARTICLES, ESPECIALLY STOCKINGS

[75] Inventor: Pier Lorenzo Migliorini, Terranuova Bracciolini, Italy

[73] Assignee: Matec S.R.L., Scandicci, Italy

[21] Appl. No.: 832,501

[22] Filed: Apr. 2, 1997

[30] Foreign Application Priority Data

Apr. 4, 1996 [IT] Italy ..... FI96A0072

[51] Int. Cl.[6] ..... D05B 21/00

[52] U.S. Cl. ..... 112/470.15

[58] Field of Search ..... 112/475.12, 470.15, 112/470.29, 470.33, 122.3, 129, 303

[56] References Cited

U.S. PATENT DOCUMENTS

| | | | |
|---|---|---|---|
| 3,900,899 | 8/1975 | Bailey | 112/475.12 X |
| 4,192,242 | 3/1980 | Haselgrove et al. . | |
| 4,444,140 | 4/1984 | Moyer | 112/475.12 X |
| 4,538,534 | 9/1985 | Frazier et al. | 112/475.12 X |
| 4,862,815 | 9/1989 | Thurner et al. | 112/475.12 X |
| 5,345,889 | 9/1994 | Gazzarrini et al. | 112/475.12 |
| 5,531,173 | 7/1996 | Migliorini | 112/470.15 |
| 5,551,362 | 9/1996 | Migliorini | 112/470.15 X |

FOREIGN PATENT DOCUMENTS 0 033 039 A1 1/1980 European Pat. Off. .

*Primary Examiner*—Ismael Izaguirre
*Attorney, Agent, or Firm*—McGlew and Tuttle

[57] ABSTRACT

Method and apparatus for treating knitted tubular articles having both ends open, wherein steps are provided for individually loading each article on a corresponding support hose in a toe-sewing machine, overturning said article on the relevant support hose and positioning it in a toe-sewing arrangement, sewing the toe along a line oriented according to a predetermined arrangement and unloading the article with the toe thus sewn, and wherein provision is made for carrying out—on the article supported by a respective hose and starting from the end opposite to the toe—a cut of predetermined length in a direction parallel to its longitudinal axis, upstream of the article-unloading station, in the same machine.

4 Claims, 2 Drawing Sheets

APPARATUS FOR TREATING KNITTED TUBULAR ARTICLES, ESPECIALLY STOCKINGS

FIELD OF THE INVENTION

The present invention refers to a method and apparatus for treating knitted tubular articles, especially stockings.

BACKGROUND OF THE INVENTION

It is well known that stockings are manufactured starting from a tubular knitted element having both ends open and that, at a later stage, one end of the element, that is, the toe, is sewn. The toe sewing operation is carried out by a so-called toe closing machine or "toe-closer" which comprises a plurality of hoses for supporting the articles in the process of formation and which are mounted on a carrousel structure rotating either intermittently or continuously between a first station for the loading, overturning and positioning of the article, a second station for the positioning of the toe to be sewn according to the curvature to be obtained, a third station in which the very sewing of the toe is performed, and a next station for the unloading of the thus treated articles.

Also known is the fact that in some cases it is required to perform, at a separate operating station, a longitudinal cutting of said articles, from the side opposite to the toe and for a length of predetermined extension, to allow them to be matched by a sewing operation manually performed in correspondence of the stocking edges thus cut, so as to form a pantyhose article. Said cut and said sewing line for joining the two stockings must be properly oriented according to a local reference, such as a preset direction with respect to the seam of each toe, in order to ensure a proper wearability of the article.

All this implies an excessively long manufacturing time, with respect to the current production requirements, and calls for the employment of means and personnel specifically in charge of the cutting and repositioning of the articles outside the toe-closer.

SUMMARY AND OBJECTS OF THE INVENTION

The advantages deriving from the present invention lie essentially in that it is possible to achieve a drastic reduction of both time and cost of manufacturing, in addition to a great simplification of the overall procedure for treating the articles due to the fact that the step for repositioning the same articles after the toe closing is suppressed; that it is possible to locate a mark on the fabric in order to indicating the site for the insertion of a perineal gusset, if any; that an apparatus conforming to the invention is of simple construction, cost-effective and reliable even after a prolonged service life.

These and other advantages and characteristics of the invention will be best understood by anyone skilled in the art from a reading of the following description in conjunction with the attached drawings given as a practical exemplification of the invention, but not to be considered in a limitative sense.

BRIEF DESCRIPTION OF THE DRAWINGS

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

In the drawings.

DESCRIPTION OF THE PREFERRED EMBODIMENT

Figure 1:
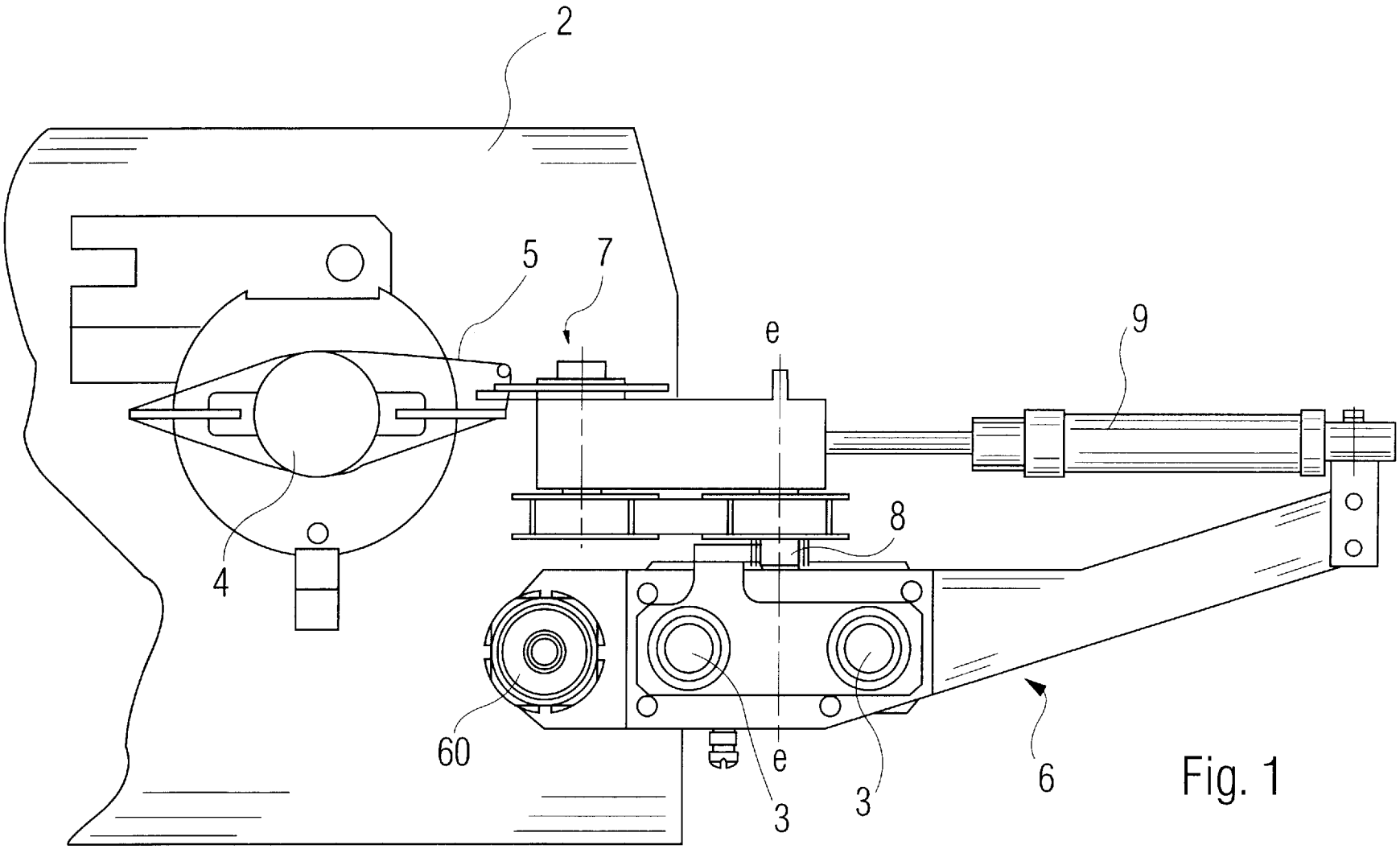
FIG. 1 shows schematically an apparatus according to the invention, in a condition suited for cutting a tubular article fitted over a respective overturning support hose.
Figure 2:
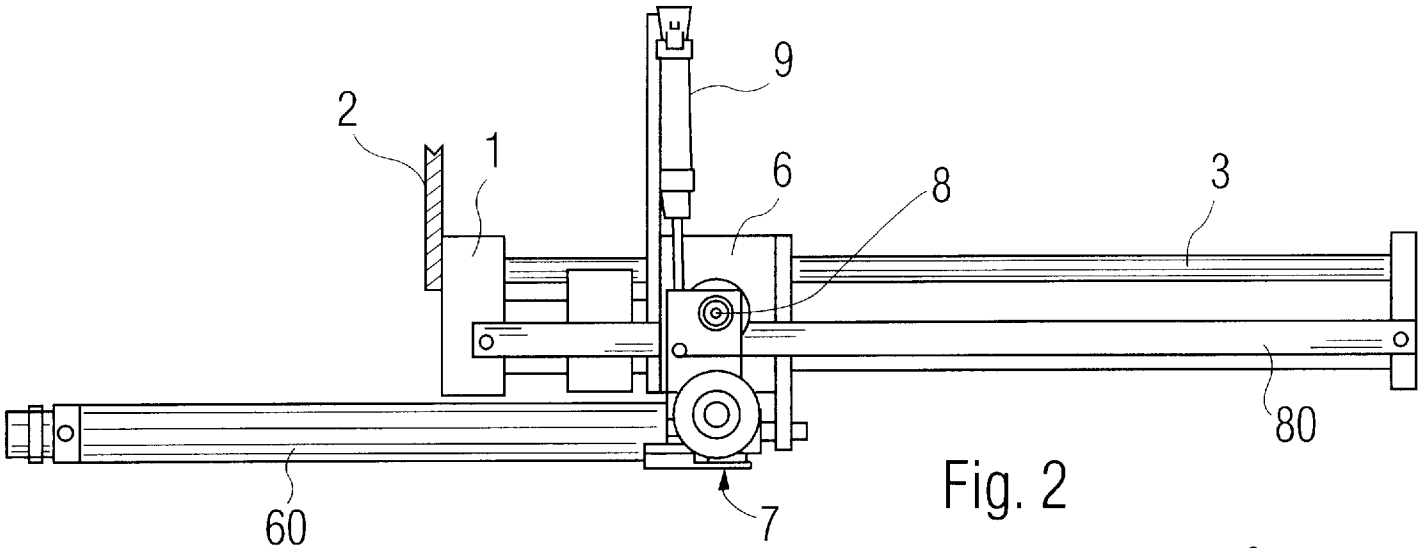
FIG. 2 shows schematically a plan view of the apparatus of FIG. 1.
Figure 3:
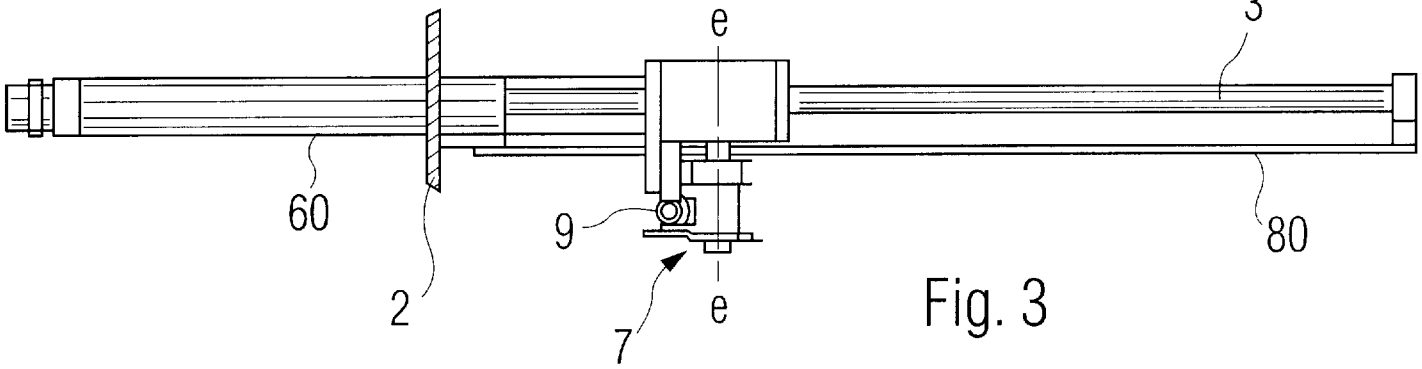
FIG. 3 shows schematically a rear view of the apparatus of FIG. 2.

Reduced to its basic structure, and reference being made to the figures of the attached drawings, a method for treating knitted tubular articles having both ends open, such as stockings for pantyhose articles, according to the invention, comprises the steps of individually loading each article on a corresponding overturning support hose in a toe closing machine, overturning said article on the respective support hose and positioning it in a toe-sewing arrangement, sewing the toe along a line oriented according to a predetermined arrangement and unloading the article with the toe thus sewn, wherein provision is made for carrying out—on the article supported by a respective hose and starting from the end opposite to the toe—a cut of predetermined length in a direction parallel to its longitudinal axis, upstream of the article-unloading station, in the same machine.

Advantageously, according to the invention, provision is made for performing said longitudinal cutting of the article in a station next to the one where the toe is sewn.

Alternatively, said cut may be made upstream of the toe-sewing machine.

Provision is also made, advantageously, for applying a mark, in the form of any suitable sign, to the fabric of the article being suitably positioned for the longitudinal cut, to allow for the subsequent application of a perineal gusset at a separate operating station.

As far as the apparatus for implementing the said operating method is concerned, it comprises a stationary basic structure (1) solid to the fixed part of the toe-sewing machine (2), which is located upstream of the station for the unloading of articles from said machine (2) and is provided with two rods (3) parallel to each other and to the hoses (4) which support the articles (5), so as to make up a guiding body for a carriage (6) having cutting means with a blade-counterblade group or unit (7), and to achieve—through the movement of the carriage (6) along the direction of the guiding rods (3)—the longitudinal cutting of the article (5) fitted over a hose (4) located in correspondence of the structure (1) and for a predetermined length corresponding to the carriage (6) travel.

Advantageously, according to the invention, said carriage (6) is engaged to corresponding driving means comprising a double-acting cylinder (60), so as to allow it to travel according to the respective axis in both directions.

Also advantageously, said blade-counterblade group (7) is pivotally mounted about the axis (e—e) of an eccentric pivot (8) carried by said carriage (6), and operated by a corresponding actuator cylinder (9) which is supported by the same carriage (6). In this way, the blade (7) is disposed in a condition suitable for the cutting of the article (5) when the relevant hose (4) is in the cutting station, that is, in correspondence of the structure (1), and in a rest position when the hose is delivered to the next station of the machine (2) upon completion of the cutting operation.

Said pivot (8) is advantageously mounted for rotating about its longitudinal axis (e—e), and partially resting on the straight fixed guide (80) solid to the base structure (1), so as to have the unit (7) cantilever mounted on the guide (80) and to ease the sliding of the carriage (6).

The functional structure of a toe-sewing machine, such as the structure of the respective operating and control means, are known per se to those skilled in the art and will not therefore be described herein in greater detail. The EP patent 33039 and U.S. Pat. No. 4,192,242 disclose toe-sewing machines for stockings.

The operation of the described apparatus is as follows.

When the article (5) supported by the respective hose (4) arrives at a position in correspondence of the structure (1) from, for example, the toe-sewing station, the activation of the cylinder (9) allows the latter to drive the unit (7) into rotation about the axis of the pivot (8) and to move the same unit to a position suitable for cutting. The subsequent activation of the cylinder (60) causes the carriage (6) with the thus positioned cutting unit (7) to travel for a length corresponding to the one of the cut to be obtained. Upon completion of the carriage (6) travel—which is controllable either mechanically by means of a travel stop or electronically by optical means known per se - the cylinder (9) drives the unit (7) into reverse rotation and the cylinder (60) brings the carriage (6) back to its initial position. Afterwards, the hose (4) with the thus treated article is moved to the unloading station of the machine (2).

In order to carry out the said longitudinal cutting of the article (5) it is not necessary to reposition the latter with respect to a local reference, as it does happen instead in the case of conventional techniques.

Moreover, it is understood that in order to perform the above said cut, means may be provided able to perform a function equivalent to that of the blade unit (7). For example, in place of the blade (7), provision may be made for an electric resistance, not shown for sake of clarity in the attached drawings, similarly mounted on the carriage (6). Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. An apparatus for treating knitted tubular articles in association with a hose for supporting the knitted tubular articles, a toe-sewing machine and a station for the unloading of articles, the apparatus comprising:

a stationary basic structure connected solidly to a fixed part of the toe-sewing machine, said stationary basic structure being located upstream of the station for the unloading of articles, said stationary basic structure including two guiding rods parallel to each other and substantially parallel to the hose for supporting the articles;

a carriage having cutting means with a blade-counterblade unit, said guiding rods of said stationary basic structure forming a guiding body for said carriage wherein through movement of said carriage along a direction of said guiding rods a longitudinal cutting of the article fitted over the hose is provided for a predetermined length corresponding to the carriage travel.

2. The apparatus according to claim 1, further comprising driving means, said carriage being engaged to said driving means, said driving means comprising a double-acting cylinder, so as to allow it to travel according to a respective axis in each of two directions.

3. The apparatus according to claim 1, further comprising:

an eccentric pivot carried by said carriage; and an actuator cylinder supported by said carriage wherein said blade-counterblade unit is pivotally mounted about an axis of said eccentric pivot and said blade-counterblade unit is operated by said actuator cylinder.

4. The apparatus according to claim 1, wherein said blade-counterblade unit includes an electric resistance element.

* * * * *